US006632104B2

(12) United States Patent
Quadir

(10) Patent No.: US 6,632,104 B2
(45) Date of Patent: Oct. 14, 2003

(54) HERMETIC TERMINAL ASSEMBLY

(75) Inventor: Tariq Quadir, West Chester, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/071,542

(22) Filed: Feb. 8, 2002

(65) Prior Publication Data

US 2003/0157831 A1 Aug. 21, 2003

(51) Int. Cl.[7] ..... H01R 13/40

(52) U.S. Cl. ..... 439/587; 439/658; 439/693; 439/736; 439/733.1; 439/727

(58) Field of Search ..... 439/658, 693, 439/587, 736, 733.1, 727

(56) References Cited

U.S. PATENT DOCUMENTS 3,160,460 A 12/1964 Wyzenbeck
4,652,074 A * 3/1987 Lombardi ..... 339/177
4,984,973 A * 1/1991 Itameri-Kinter et al. .... 417/422
5,029,969 A 7/1991 Seike et al.
5,090,793 A 2/1992 Seike et al.
5,344,337 A 9/1994 Ritter
5,493,073 A * 2/1996 Honkomp ..... 174/152

OTHER PUBLICATIONS

Two (2) Photographs of power bolt (2 pages) (date unkown).

* cited by examiner

*Primary Examiner*—Tho D. Ta
*Assistant Examiner*—Truc Nguyen
(74) *Attorney, Agent, or Firm*—Harness, Dickey & Pierce P.L.C.

(57) ABSTRACT

A hermetic or semi-hermetic terminal assembly having a cup-shaped body portion with a generally flat bottom wall and at least one opening in the bottom wall defined by an annular lip extending into the cup. One current conducting pin extends through each opening and beyond the lip on both ends of the body portion, the inner end of the pin being on the dish side of the cup-shaped body portion, and the outer end on the outer side of the body. A resilient plastic material is molded into place within the body portion to bond the pin to an inside surface of the lip with a hermetic seal. The plastic extends beyond the face of the body portion and bonds to the pin to provide the desired air path between the respective pins and each other and/or the face of the body portion.

21 Claims, 4 Drawing Sheets

HERMETIC TERMINAL ASSEMBLY

FIELD OF THE INVENTION

The present invention relates to electric terminals, and more particularly to terminals of the type which include one or more conductor pins which project through and are secured to a metallic body portion by a hermetic seal for disposing the ends of the conductor pins on opposite sides of the body portion.

BACKGROUND OF THE INVENTION

Hermetically sealed electric terminals provide an airtight electrical terminal for use in conjunction with hermetically sealed devices where leakage into or from such devices, by way of the terminals, is effectively precluded. For hermetically sealed electric terminals to function safely and effectively for its intended purpose, the terminals require that their conductor pins be electrically insulated from and hermetically sealed to the body portion through which they pass and that an optimum air path be established and thereafter maintained between adjacent portions of the pins and opposite sides of the body.

In a conventional hermetic terminal assembly, exemplified by U.S. Pat. No. 3,160,460 to Wyzenbeek, a straight, current carrying pin is fixed in place within a lip defining a hole in the terminal body by a fusible glass-to-metal seal. A resilient insulator is bonded to the face of the body beyond the extent of the glass-to-metal seal. The insulator includes outwardly projecting portions bonded to the conductor pins which define a predetermined air path between adjacent portions of the pins and the body member. Such a hermetic terminal construction has been the standard in the industry for four decades.

The primary object of the present invention is to provide a hermetic terminal assembly having conductor pins that are rigidly and hermetically secured to the body portion entirely by a resilient plastic which possesses the requisite materials properties, such as dielectric, moisture resistance, resistance to chemical breakdown, to provide for a hermetic seal. In addition to providing a hermetic seal between the conductor pins and the body, the same resilient plastic is bonded to the conductor pins to provide the desired air path between the pins and the face of the body portion.

Another object of the present invention is to provide such a terminal that is simple and economical to manufacture, such as by plastic injection molding.

SUMMARY OF THE INVENTION

The present invention provides a hermetic terminal assembly having a cup-shaped body portion with a generally flat bottom wall and at least one opening in the bottom wall defined by an annular lip. A current conducting terminal pin extends through each opening and beyond the lip on both ends of the body portion, the inner end of the terminal pin being on the dish side of the cup-shaped body portion, and the outer end of the terminal pin extending through and to the outer side of the body portion. A resilient plastic resin material is molded into place within the body portion and interlocks with the body portion and the terminal pins to fixedly secure the terminal pins in position relative to the body portion. The plastic resin material forms a hermetic seal between the terminal pin and the body portion. In addition, the plastic extends beyond the face of the body portion and covers the pin to provide the desired air path between the respective pins and each other and/or the face of the body portion.

In alternate embodiments of the present invention, the terminal pins include shank portions with varying surface configurations that are intended to enhance the bonding of the plastic resin to the terminal pin and improve the hermeticity of the seal. The terminal pins may also include fuse portions that are intended to open in response to predetermined current loads seen at the terminal pins.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
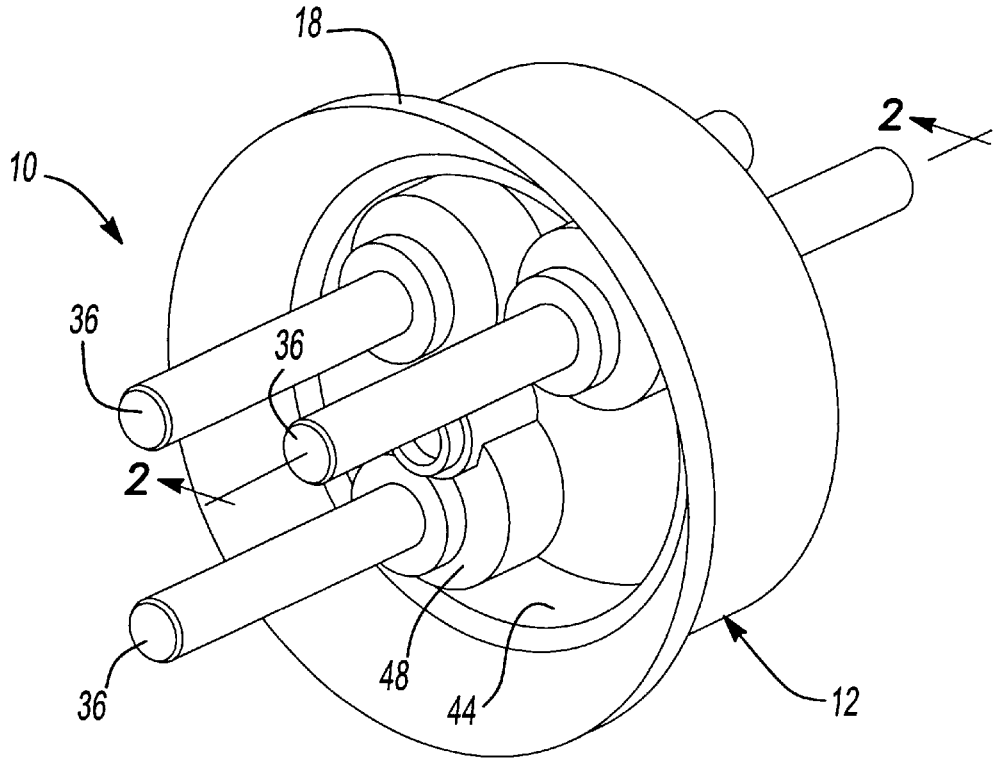
FIG. 1 is a perspective view of a hermetic terminal assembly.
Figure 2:
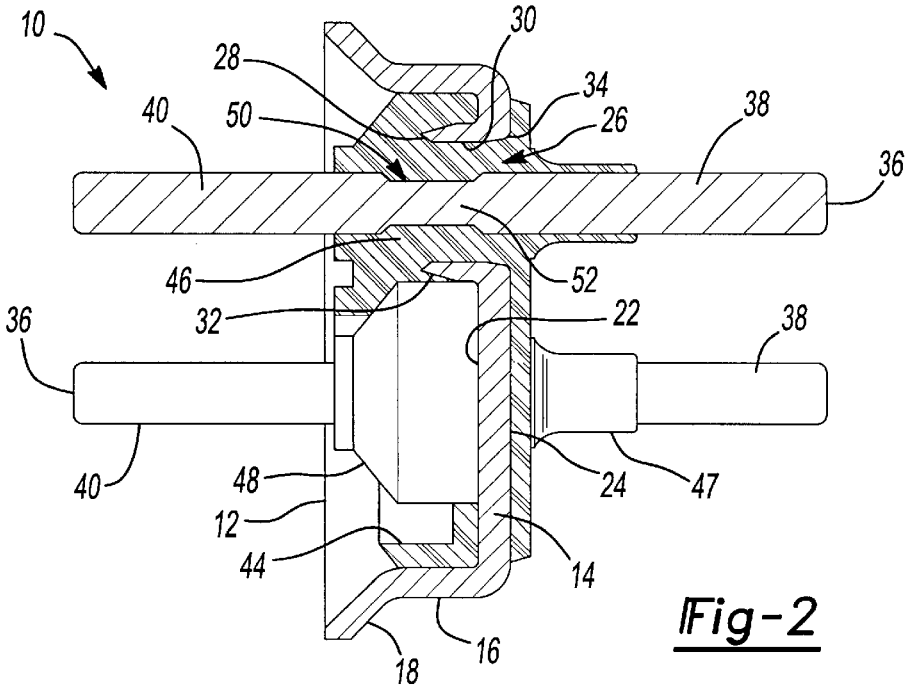
FIG. 2 is a cross-sectional side view of a first embodiment of the hermetic terminal assembly of the present invention.
Figure 3:
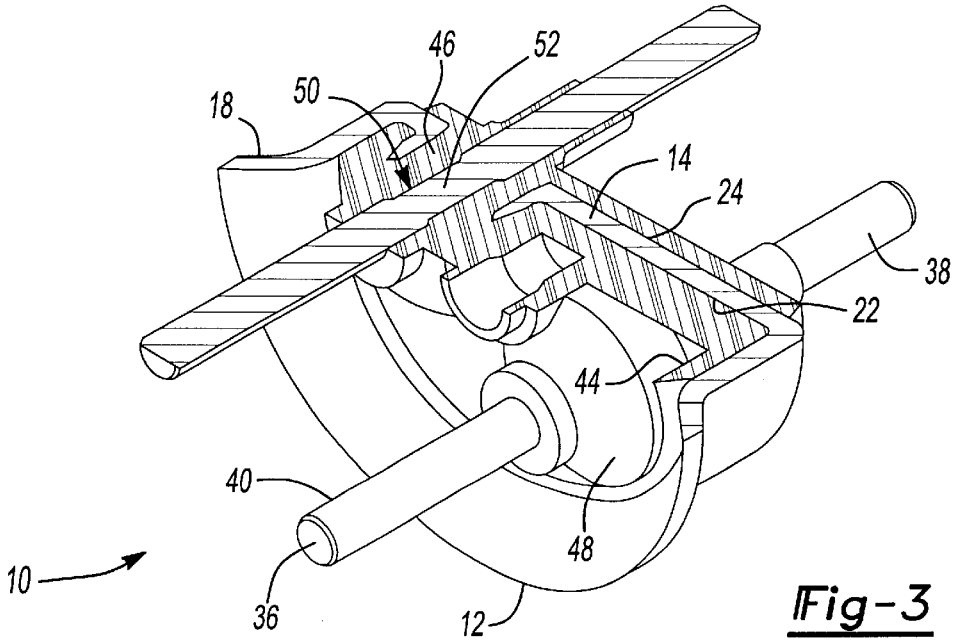
FIG. 3 is a cross-sectional perspective view of the hermetic terminal assembly of FIG. 2.

Referring now to the drawings FIGS. 1, 2 and 3, a hermetic terminal assembly 10 having a generally cup-shaped body portion 12 with a generally flat bottom 14 and side wall 16 with an outwardly flaring rim 18. The bottom 14 of the body portion 12 has a dish-side interior surface 22, an outside surface 24, and a plurality of openings 26. The openings 26 are each defined by an annular lip 28 with an inside wall surface 30, a free edge 32 on the dish side, and a radius 34 on the outside.

A current carrying terminal pin 36 with an outer end 38 and an inner end 40 may be fitted with a conventional terminal tab (not shown). The current carrying pin 36 is sealed within the opening 26 by a dielectric plastic resin material 44 that is molded directly into the body portion 12, which bonds to the body portion 12 and terminal pin 36. As molded, the plastic resin 44 creates a seal 46 that is an airtight hermetic seal between the terminal pin 36 and the body portion 12 such that leakage through the assembly 10, by way of the terminal pins 36, is prevented.

In a preferred embodiment, the plastic resin 44 is molded in and around the body portion 12 on each side of the bottom 14. The plastic resin 44 thereby covers both the dish-side surface 22 and the outside surface 24 of the bottom wall 20 and is mechanically interlocked with the body portion 12. The plastic resin provides an dielectric oversurface that covers the inside and outside of the terminal 10 body portion 12. Additionally, the plastic resin 44 may also include a sleeve portion 47 that bonds to and covers a portion of the terminal pin 36 projecting out of the body portion 12 to the outer end 38 of the to define the air path between the respective terminal pins 36 and/or the body portion 12, as desired.

On the dish-side, interior surface 22 of the body portion 12, the molded plastic resin 44 forms a plurality of neck portions 48 each of which is adjacent to, and surrounds, the annular lip 28 defining an opening 26 in the bottom wall 20 of the body portion 12. Each neck portion 48 extends along its respective terminal pin 36 toward the inner end 40 for about a quarter to a third of the distance that the terminal pin 36 protrudes from the dish-side surface 22 of the terminal 10 body portion 12. In addition to providing a dielectric oversurface, the neck portions 48 increase the length of the hermetic seal 46 and better fixes the terminal pins 36 in place.

Each terminal pin 36 has a shank portion 50 which passes through the terminal 10 body portion 12. The plastic resin 44 fills the space between the inside wall 30 and the shank portion 50 of the terminal pin 36 to create the hermetic seal 46 and to bond the terminal pin 36 to the terminal 10 body portion 12. Included in the shank portion 50 of the terminal pin 36 is a fuse section 52 which is encompassed by the seal 46 so as to be internal to the terminal 10 body portion 12. The fuse section 52 has a necked down diameter from the remainder of the terminal pin 36. The fuse section 52 is intended to open at currents in excess of a predetermined current-carrying capacity. Alternatively, the terminal pin 36 may be configured with a fuse that is external to the terminal 10 body portion 12, such as a terminal pin that is disclosed in U.S. Pat. No. 5,017,740 to Honkomp et al., which is hereby incorporated into this disclosure by reference.

The plastic resin 44, molded to create the hermetic seal 46, must possess the appropriate electrical and mechanical properties that are required for the application and operating environment in which the hermetic terminal assembly will be utilized. Typical minimum engineering material requirements may include:

| Physical Property | Requirement |
|---|---|
| Hydrostatic Pressure | 2250 psi |
| Hermeticity | $1 \times 10^{-7}$ cc/sec He |
| Dielectric Voltage | Minimum 2500 V with <0.5 mA leakage |
| Insulation Resistance | >10,000 MΩ at 500 Vdc |
| Operating Temperature | 150° F. to 300° F. |
| Operating Environment | Mineral oil or refrigerant |

A plastic resin that is suitable for use with the present invention is a moldable plastic resin which can provide the dielectric oversurface and hermetic seal 46 as disclosed. One such moldable plastic resin is polyphenyl sulfide (PPS), which is know under the tradename RYTON. In addition, other moldable plastic resins that possess the necessary electrical and mechanical properties may also be used, including liquid crystalline polymer compositions (LCPs). An example of one such material is available commercially from DuPont under the tradename Zenite®.

Further, there may applications for the terminal assembly 10 of the present invention having less demanding operational or performance requirements, where a fully hermetic seal may not be not necessary, and a less-than-airtight, semi-hermetic seal or even non-hermetic seal is all that is required. It is fully contemplated that a terminal assembly 10 of the present invention may be applicable for use in such applications. Additional moldable plastic resins that may be suitable for use with this invention in such applications are polypropylenes, thermoplastic polyolefins, and polyvinylchlorides like Bakelite®.

The terminal pin 36 is manufactured from an electrically conductive material, such as solid copper or steel. Alternatively, a bimetallic, copper core wire, having high electrical conductivity and possessing good hermetic bond characteristics with the plastic resin 44 may also be utilized.

Figure 4:
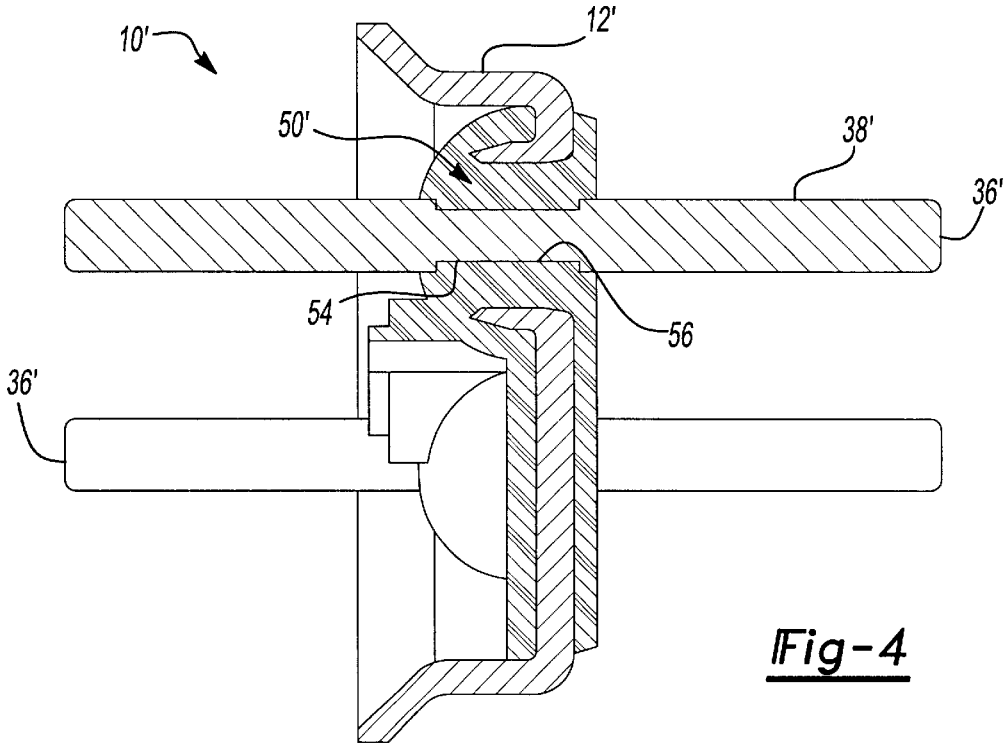
FIG. 4 is a cross-sectional side view of a second embodiment of the hermetic terminal assembly of the present invention.

Referring now to FIGS. 3 and 4, a second embodiment of the hermetic terminal assembly 10' of the present invention is illustrated. Elements and features common to both the first and second embodiments shown in the Figures are identified with like reference numerals.

Included in the shank portion 50' of the terminal pin 36' is a section 54 having a scuffed surface 56 of increased surface roughness. Such a surface may be achieved by mechanical means, such as sanding or grit blasting the terminal pin 36' or by other similar processes, or by chemical means. The scuffed surface 56 is included in terminal pin 36' to create an increased surface area over which the plastic resin 44' may contact and mechanically engage the terminal pin 36' to increase the strength of the bond with the plastic resin 44' and improve the hermeticity of the seal 46'. Although not shown in FIGS. 3 and 4, the terminal pin 36' may also incorporate a fuse section, similar to that disclosed above. Such a fuse section could also include a scuffed surface 56.

Additionally, as described above, the plastic resin 44' may also cover a portion of the projecting outer end 38' of the terminal pin 36' to define the air path between the respective terminal pins 36' and/or the body portion 12', as desired.

Figure 5:
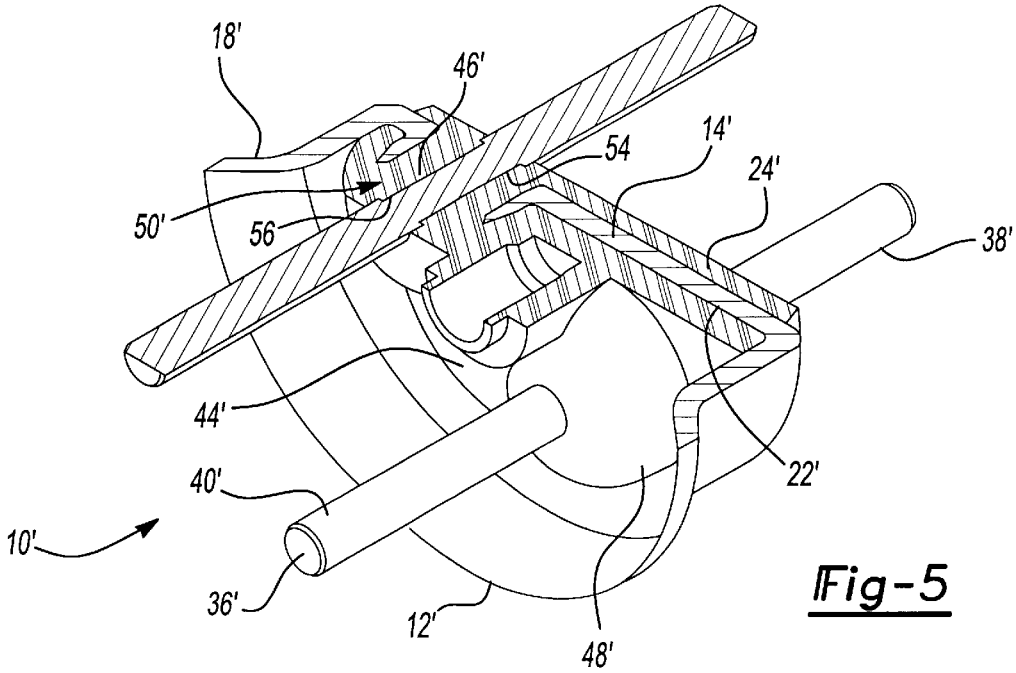
FIG. 5 is a cross-sectional perspective view of the hermetic terminal assembly of FIG. 4.
Figure 6:
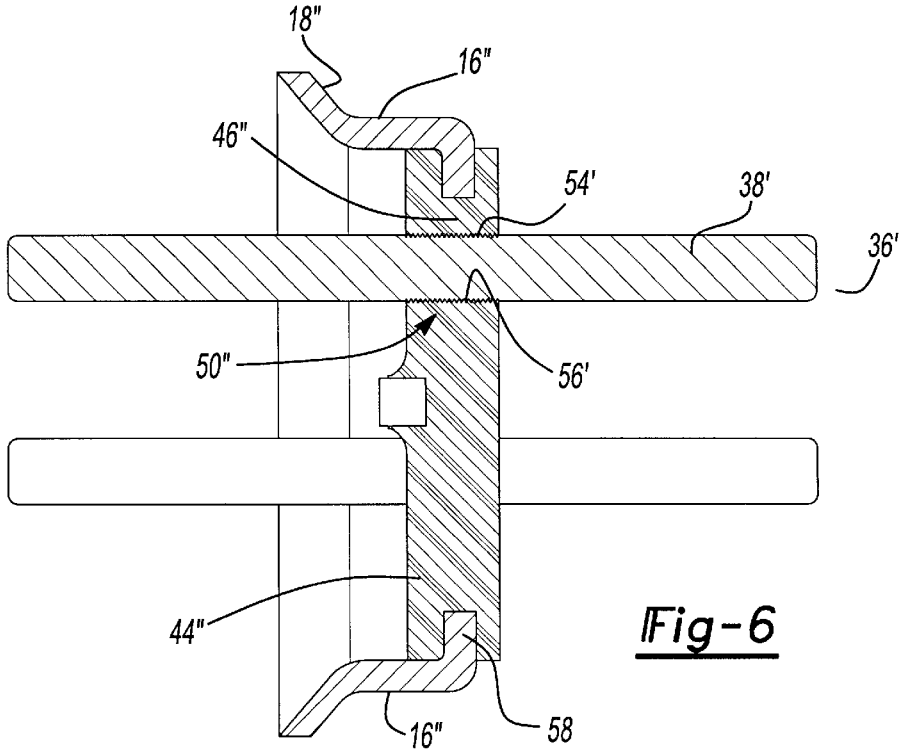
FIG. 6 is a cross-sectional side view of a third embodiment of the hermetic terminal assembly of the present invention.
Figure 7:
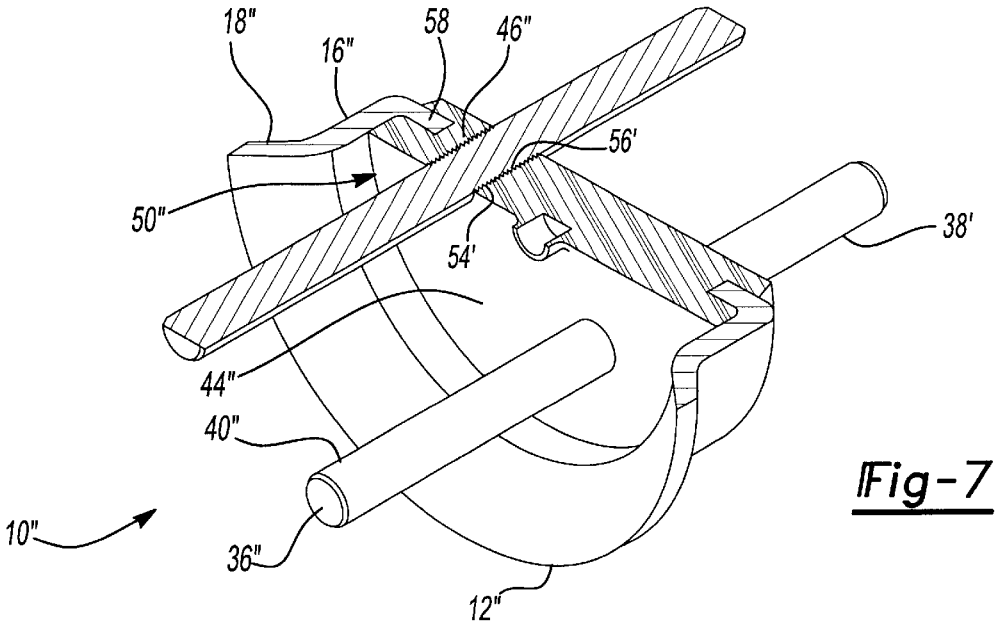
FIG. 7 is a cross-sectional perspective view of the hermetic terminal assembly of FIG. 6.

Yet another embodiment of the hermetic terminal assembly 10" of the present invention is shown in FIGS. 5 and 6. In this third embodiment, the terminal 10" has a generally cup-shaped body portion 12" with a side wall 16" having an outwardly flaring rim 18". The body portion does not have a generally continuous, closed bottom, but instead has only an inwardly extending peripheral lip 58 which extends from the side wall 16" at the end opposite the rim 18". The plastic resin 44" is molded in and around the peripheral lip 58 and is thereby mechanically interlocked with the body portion 12". As with those embodiments described above, the plastic resin 44" may also be molded over a portion of the projecting outer end 38" of the terminal pin 36" to define the air path between the respective terminal pins 36' and/or the body portion 12", as desired.

The terminal pin 36" of the third embodiment of the present invention may also differ from the terminal pins 36 and 36' disclosed above. As shown in FIG. 5, the shank portion 50" of the terminal pin 36" is a section 54' forming a threaded surface 56'. Similar to that described above, the threaded surface 56' is included in terminal pin 36" to increase the surface area of the terminal pin 36" over which the plastic resin 44" may contact and mechanically engage the terminal pin 36". The increased area of engagement correspondingly increases the strength of the bond between the terminal pin 36" and the plastic resin 44" and improves the hermeticity of the seal 46". Again, the terminal pin 36" may also incorporate a fuse section, similar to that disclosed with respect to FIGS. 1 and 2 above. Such a fuse section could also include a threaded surface 56'.

Of course, any of the features of the body portions 12, 12', 12" or terminal pins 36, 36', 36" may be combined in various ways to create a hermetic terminal assembly within the contemplation of the present invention.

While the invention has been disclosed and described in its presently preferred form(s), it is understood that the invention is capable of modification without departing from the spirit and scope of the invention as set forth in the appended claims.

What is claimed is:

1. A hermetic terminal assembly comprising:

a metallic body, said body having a bottom portion and a side wall, said bottom portion comprising an interior surface, an outer surface and at least one opening having a wall;

a current conducting pin extending longitudinally through said opening in said bottom portion;

a monolithic dielectric plastic resin covering at least portions of each of said interior surface, said exterior surface, and said wall of said opening of said bottom portion of said body, said monolithic dielectric plastic resin bonding directly to both said body and said pin and providing a seal between said pin and said opening in said bottom portion through which said pin is extending.

2. A hermetic terminal assembly according to claim 1, wherein said plastic resin comprises a neck portion that is surrounding said opening in said bottom portion of said body.

3. A hermetic terminal assembly according to claim 1, wherein said pin comprises a shank portion that passes through said opening in said bottom portion of said body, said shank portion of said pin comprising a fuse that opens in response to a predetermined amperage of electric current passing there through.

4. A hermetic terminal assembly according to claim 1, wherein said pin comprises a shank portion that passes through said opening in said bottom portion of said body, said shank portion of said pin comprising an irregular outer surface that tends to improve said bonding of said plastic resin to said pin.

5. A hermetic terminal assembly according to claim 1, wherein said seal is a hermetic seal.

6. A hermetic terminal assembly according to claim 1, wherein said seal is a semi-hermetic seal.

7. A hermetic terminal assembly according to claim 2, wherein said plastic resin comprises a sleeve portion which surrounds said pin and extends longitudinally along said pin and beyond said body.

8. A hermetic terminal assembly according to claim 3, wherein said fuse has a diameter that is less than the diameter of adjacent portions of said pin.

9. A hermetic terminal assembly according to claim 3, wherein said fuse has an irregular outer surface that tends to improve said bonding of said plastic resin to said pin.

10. A hermetic terminal assembly according to claim 4, wherein said irregular outer surface is a screw thread.

11. A hermetic terminal assembly according to claim 4, wherein said pin comprises a fuse that opens in response to a predetermined amperage passing there through, said fuse positioned on said pin at a location other than at said shank.

12. A terminal assembly comprising:

a metallic body, said body having a side wall and a bottom peripheral lip defining an opening through said body, said peripheral lip extending inwardly toward a longitudinal center of said body from said side wall, said peripheral lip comprising an interior surface, an exterior surface and an longitudinally extending wall;

a plurality of current conducting pins extending longitudinally through said opening of said body;

a monolithic plastic resin covering at least portions of each of said interior surface, said exterior surface and said longitudinally extending wall of said bottom peripheral lip, said monolithic plastic resin bonding directly to both said body and said pin, and providing a seal between said pins and said opening in said bottom portion through which said pins are extending.

13. A terminal assembly according to claim 12, wherein said plastic resin comprises a sleeve portion which surrounds said pin and extends longitudinally along said pin and beyond said body.

14. A terminal assembly according to claim 12, wherein said pin comprises a shank portion that passes through said opening in said body, said shank portion of said pin comprising a fuse that opens in response to a predetermined amperage of electric current passing there through.

15. A terminal assembly according to claim 14, wherein said fuse has a diameter that is less than the diameter of adjacent portions of said pin.

16. A terminal assembly according to claim 14, wherein said fuse has an irregular outer surface that tends to improve said bonding of said plastic resin to said pin.

17. A terminal assembly according to claim 12, wherein said pin comprises a shank portion that passes through said opening in said bottom portion of said body, said shank portion of said pin comprising an irregular outer surface that tends to improve said bonding of said plastic resin to said pin.

18. A terminal assembly according to claim 12, wherein said seal is a hermetic seal.

19. A terminal assembly according to claim 12, wherein said seal is a semi-hermetic seal.

20. A terminal assembly according to claim 17, wherein said irregular outer surface is a screw thread.

21. A terminal assembly according to claim 17, wherein said pin comprises a fuse that opens in response to a predetermined amperage passing there through, said fuse positioned on said pin at a location other than at said shank.

* * * * *

UNITED STATES PATENT AND TRADEMARK OFFICE

CERTIFICATE OF CORRECTION

PATENT NO. : 6,632,104 B2
DATED : October 14, 2003
INVENTOR(S) : Tariq Quadir

It is certified that error appears in the above-identified patent and that said Letters Patent is hereby corrected as shown below:

Column 3,
Line 50, "$1x10^{7}$" should be -- $1x10^{-7}$ --.

Signed and Sealed this

Twenty-seventh Day of January, 2004

JON W. DUDAS
*Acting Director of the United States Patent and Trademark Office*